United States Patent [19]

Appleman et al.

[11] 4,378,072

[45] Mar. 29, 1983

[54] GANTRY CRANE

[75] Inventors: William S. Appleman, Durham; James D. Sturgill, Roxboro, both of N.C.

[73] Assignee: RPC Corporation, Roxboro, N.C.

[21] Appl. No.: 159,969

[22] Filed: Jun. 16, 1980

[51] Int. Cl.[3] ..... B66C 5/02

[52] U.S. Cl. ..... 212/218; 414/460

[58] Field of Search ..... 212/206, 214, 218, 219, 212/220; 414/459, 460, 461; 254/324; 280/111

[56] References Cited

U.S. PATENT DOCUMENTS

| | | | |
|---|---|---|---|
| 2,706,057 | 4/1955 | Belding | 414/459 |
| 3,110,404 | 11/1963 | De Stasi | 414/460 X |
| 3,558,172 | 1/1971 | Lamer et al. | 414/459 X |
| 3,677,572 | 7/1972 | Fontan et al. | 414/459 X |
| 3,759,409 | 9/1973 | Wenzel et al. | 212/218 X |
| 3,805,967 | 4/1974 | Scannell | 212/218 X |
| 4,119,229 | 10/1978 | Holmes et al. | 414/460 |
| 4,219,094 | 8/1980 | Sturgill | 414/460 X |
| 4,236,859 | 12/1980 | Stearn et al. | 414/460 |
| 4,279,347 | 7/1981 | Appleman | 212/220 X |

FOREIGN PATENT DOCUMENTS

| | | | |
|---|---|---|---|
| 654486 | 12/1962 | Canada | 212/218 |
| 787747 | 6/1968 | Canada . | |

*Primary Examiner*—Robert B. Reeves
*Assistant Examiner*—Edward M. Wacyra
*Attorney, Agent, or Firm*—Shlesinger, Arkwright, Garvey and Dinsmore

[57] ABSTRACT

A gantry crane comprising a pair of spaced, parallel rectangular side frames each having top and bottom members and front and rear vertical members connected to the top and bottom members, a front cross beam rigidly connected to each of the side frames at the upper front corners thereof, and a rear cross beam pivotally connected to each of the side frames at the upper rear corners thereof, each of the side frames further including diagonal braces, ground engaging drive wheels mounted on the side frames at the lower corners thereof so that as the gantry crane traverses uneven ground, the wheels maintain ground contact as the rear cross beam pivots with respect to the side frames and the front cross beam absorbs the torsional stress.

6 Claims, 6 Drawing Figures

GANTRY CRANE

This invention relates to a gantry crane of the type commonly used for materials handling, and particularly for handling containerized freight or large, bulky loads.

More particularly, this invention deals with an improved gantry crane which is capable of maintaining ground contact with the drive wheels while traversing uneven ground.

BACKGROUND AND OBJECTS

Gantry cranes are of a type designed to straddle a load, and generally have a pair of side frames connected by a pair of cross rails. The side frames and cross rails are rigidly connected to form a very sturdy unit capable of lifting large loads, and for transporting these loads along the ground. Typically, a pair of lifting winches or the like are mounted on the cross members and may include grappling hooks, load lifting straps, or the like for engaging the load and lifting the same.

Such gantry cranes are commonly used in railroad yards for handling containerized freight or truck trailers, or are used in other storage yards for handling large, bulky loads such as pipe. In construction yards, such cranes find a wide range of use in material distribution, yard maintenance, loading and unloading heavy machinery, and moving fragile equipment. Such cranes are also commonly used for handling large concrete sections such as bridge beams, highway dividers, roof beams, wall sections, large diameter pipe, for launching large boats, and many other applications where the lifting and transport of bulky or difficult to handle items is required.

The gantry cranes in present use typically are provided with one or more wheels at each corner thereof, some or all of which may be steerable and some or all of which may be driven.

The rigid construction of such cranes as heretofore used has been necessary for strength as well as for ease of manipulation and maximum lifting capability. However, the rigidity of such cranes has also been the cause of a significant problem. When such cranes would move along uneven terrain such as would be commonly found in construction yards, railroad yards, or the like, it was not uncommon to have one of the wheels be actually lifted off of the ground at the point where it encountered a low spot. If the wheel which lost ground contact were a steerable wheel or a driven wheel, the crane would lose motive drive and would also lose some steerability. Such cranes were not provided with any type of suspension system which would accomodate uneven terrain.

The present invention overcomes this problem by providing a gantry crane having a strong axis versus weak axis construction which results in a type of "suspension" which enables all of the wheels of the crane to maintain full ground contact over fairly wide variations in terrain. This is achieved by providing a pair of rigid side frames which are pivotally connected at the top rear corners by means of a pivotal connection to a cross beam, and are rigidly connected to a cross beam at the top front corners. The side frames are designed to be substantially rigid, and thus when uneven terrain is encountered, pivotal motion of the rear portion of the frame results in a torsional bending of the front cross beam.

Accordingly, it is a primary object of the present invention to provide a gantry crane which is capable of maintaining full ground contact over uneven terrain.

A further object of this invention is to provide a gantry crane having a strong axis versus weak axis design to provide a type of suspension system.

Still another object of this invention is to provide a gantry crane having an improved operator cab arrangement.

Yet another object of this invention is to provide an improved gantry crane of a type which overcomes the disadvantages of prior art cranes.

DESCRIPTION OF THE DRAWINGS

These and other objects and advantages of this invention will become apparent when considered in light of the following description and claims when taken together with the accompanying drawings in which:

DESCRIPTION OF THE INVENTION

Figure 1:
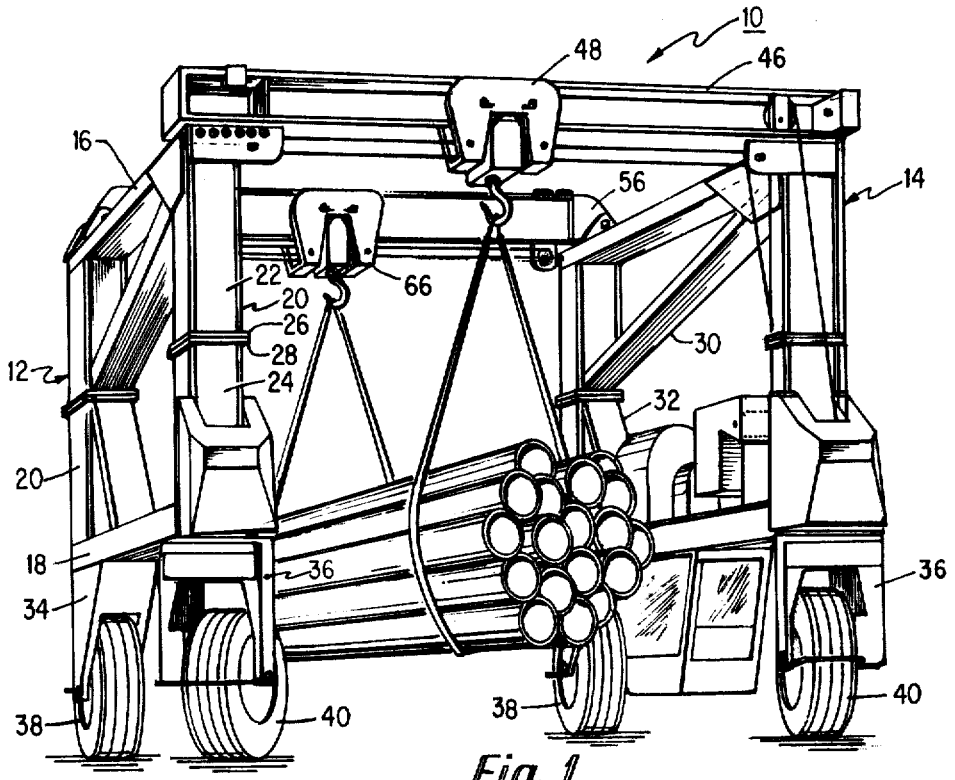
FIG. 1 is a front perspective view of the gantry crane of this invention.

Referring first to FIGS. 1 through 4 of the drawings, the gantry crane generally designated 10 is seen to include a pair of side frames generally designated 12 and 14. Each of the side frames includes horizontal top plate 16 and horizontal bottom plate 18, and parallel vertical support columns 20. Each of the support columns 20 includes a unitary upper section 22 and a unitary lower section 24 connected at a joint located generally at the mid-portion of each column 20. Each of the sections 22 and 24 are provided with flanges 26 and 28 respectively in order that the upper sections 22 may be bolted to the lower sections 24 to provide a rigid column.

Figure 2:
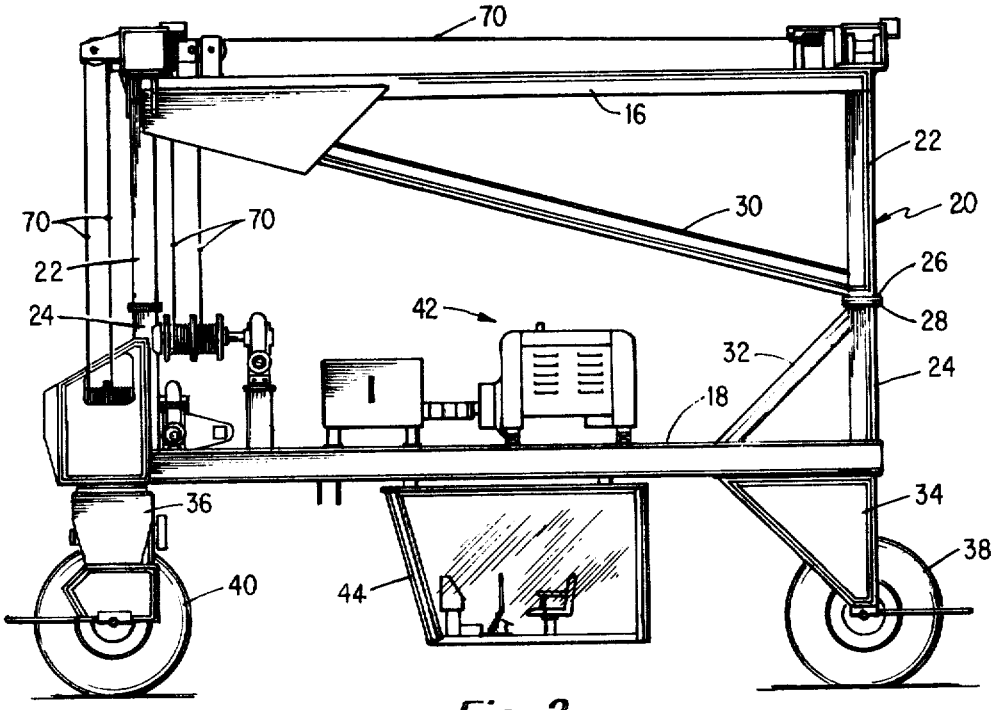
FIG. 2 is a side elevation view thereof.

The vertical support columns 20 are rigidly connected to the top and bottom plates 16 and 18 as by bolting, welding, or other suitable technique, so as to provide a generally rectangular frame. In order to provide greater strength and rigidity to the side frames 12 and 14, a diagonal bracing system is provided. Preferably, this bracing system includes a single unitary first bracing member or beam 30 which is integrally attached to the upper section 22 of the rear vertical support column just above the flange 26, as by welding, bolting or other suitable means. This reinforcing member 30 extends uninterrupted diagonally upwardly the length of each side frame 12 and 14 as best seen in FIGS. 1 and 2 to a point at which it is integrally attached to the top plate 16, adjacent the opposite vertical support column.

A single unitary second diagonal bracing member or beam 32 is provided which is integrally attached to the lower section 24 just below the flange 28, and extends uninterrupted diagonally downwardly until it meets the bottom plate 18 to which it is integrally attached. The second diagonal brace 32 does not need to be as long as the first brace, since most of the forces are acting on the upper portion of the frame. Thus the upper brace 30 should extend substantially the full length of the top plate 16, while the lower brace need only extend a relatively short distance as shown.

Thus the top plate 16, the upper sections 22 of the support columns 20 and the first bracing member 30 are permanently joined in fixed interrelationship thereby forming an upper unitary portion of each side frame 12 and 14. The bottom plate 18, the lower sections 24 of the columns 20 and the second bracing member 32 are similarly joined thereby forming a lower unitary portion of each side frame 12 and 14.

This type of brace system has been found to be superior to other braces such as an X-frame, since it provides improved strength and also enables disassembly of the side frames 12 and 14 at the flanges 26 and 28 to facilitate transportation of the crane or to permit use of a spacer as will be discussed later. For maximum strength of the side frames, it is preferable that the top and bottom plates 16 and 18, as well as the diagonal bracing members 30 and 32, should be formed of box-section members, although H-section girders provide sufficient strength for the vertical support columns.

Each of the side frames 12 and 14 is provided at its lower corners with rear yokes 34 and front yokes 36 which mount rear wheels 38 and front wheels 40 in a conventional manner. In the preferred embodiment, the front yokes 36 are steerable by a conventional hydraulic or mechanical steering mechanism and are also driven by any suitable drive motor. On one of the side frames, a suitable power plant generally designated 42 is provided. This may be a gasoline engine, or an internal combustion engine which may operate on liquified petroleum gas, or other suitable power plant. Appropriate hydraulic systems and mechanical and gearing systems are provided for driving and steering the gantry crane as well as for operating the lifting mechanism. The power plant 42 and associated equipment is mounted above one of the bottom plates 18 as shown.

Suspended beneath the power plant 42 and bottom plate 18 is the operator cab generally designated 44. By mounting the cab beneath this plate 18, the operator has greater visibility, and ease of operability of the gantry crane is enhanced considerably.

Figure 3:
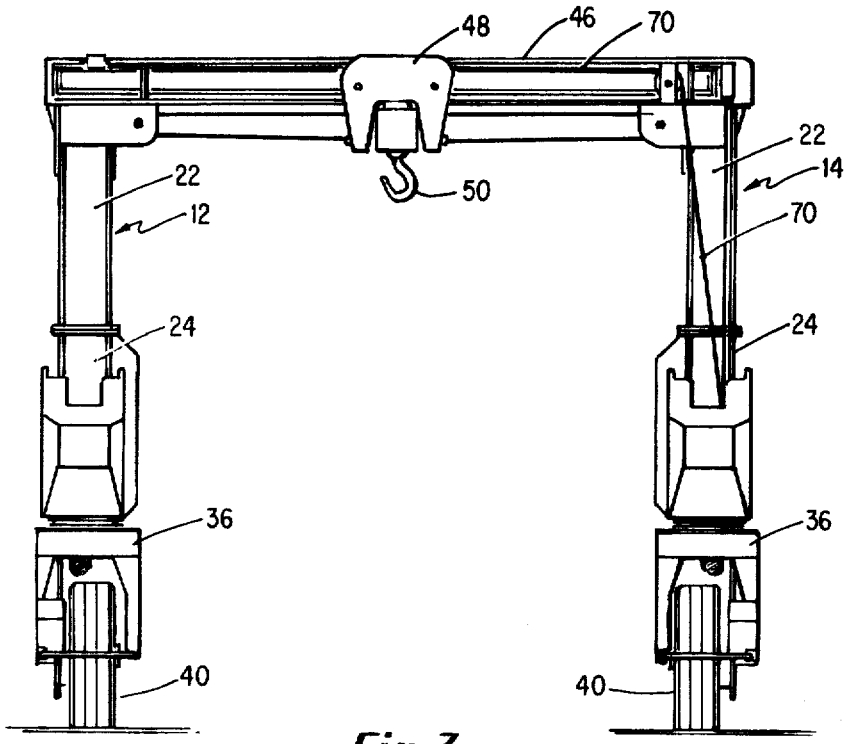
FIG. 3 is a front elevation view of the gantry crane of this invention.

As best seen in FIGS. 1 and 3, a front cross beam 46 connects the side frames 12 and 14. The front cross beam 46 is preferably bolted to the side frames, or in turn may be welded to brackets which are bolted to the side frames. Through the use of bolts, the crane may be shipped to the site in an unassembled form, and assembled at the job site. This can significantly reduce transportation costs. However the connection between the front cross beam 46 and the side frames 12 and 14 must be rigid. The front cross beam 46 is provided with a trolley 48 with associated pulleys (not shown) and a hook 50 which may be used with any conventional mode gripping attachment. The front cross beam 46 is preferably of an H cross section and thereby provides rails upon which the trolley 48 may travel.

Figure 4:
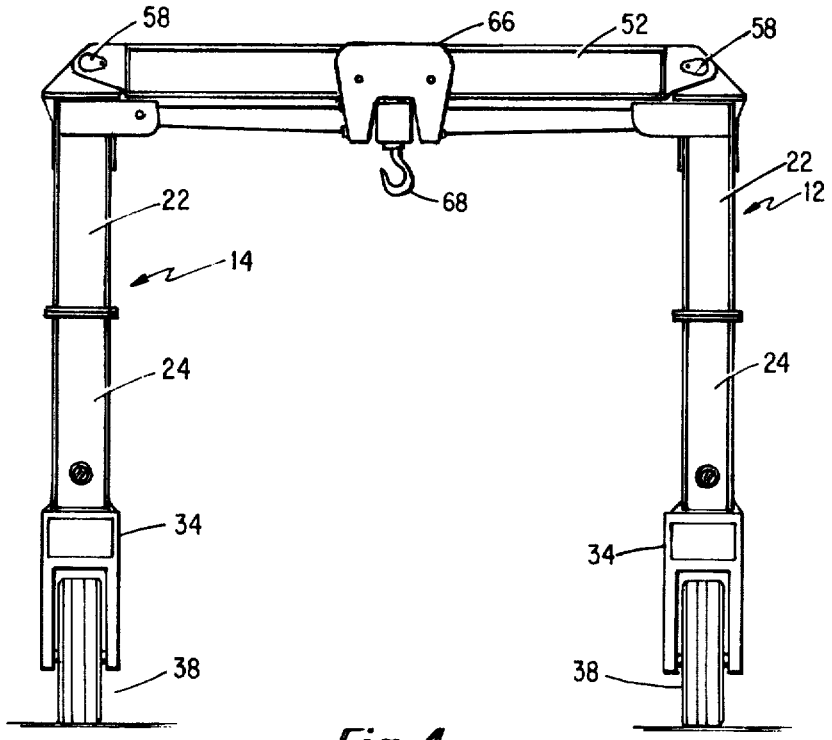
FIG. 4 is a rear elevation view of the gantry crane of this invention.
Figure 5:
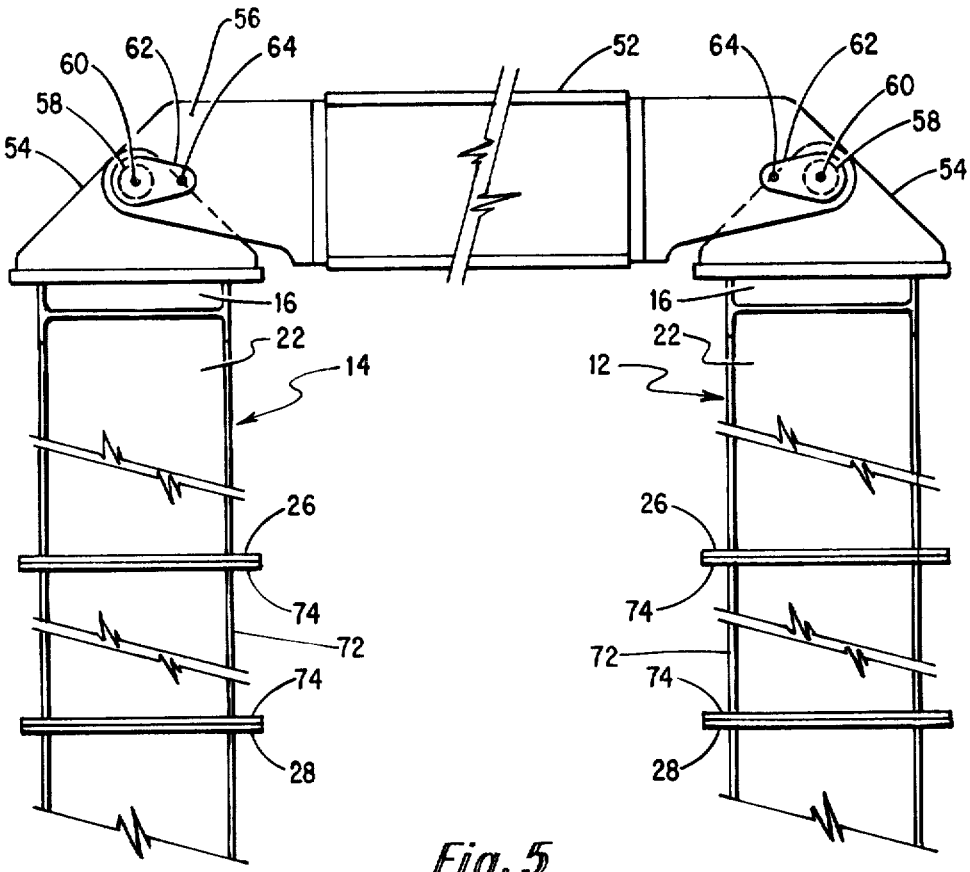
FIG. 5 is an enlarged fragmentary view of a portion of the gantry crane.
Figure 6:
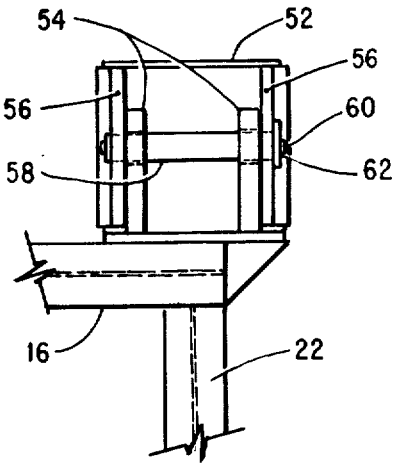
FIG. 6 is a side elevation view of the structure of FIG. 5.

Referring to FIG. 4, a rear cross beam 52 is provided for connecting the side frames 12 and 14 near the upper, rear corners thereof. For this purpose, the top plates 16 are provided with trunnions 54 suitably attached as by welding thereto. The rear cross beam 52 is provided with cooperating flanges 56 which lie adjacent to trunnions 54 as seen in FIG. 6. The trunnions 54 and the flanges 56 are provided with aligned openings in order that a trunnion pin 58 may pass through the openings on the trunnions 54 and flanges 56 and establish a pivotal connection, with the axis 60 of the trunnion pin being the pivot axis. The trunnion pin 58 is also provided with a flange 62 which extends away from the pivot axis as seen in FIG. 5 and is provided with a bolt hole 64. In this manner, the trunnion pin 58 may be secured to the flange 56 by a bolt connection, and similarly, the trunnion pin may be removed for disassembly of the gantry crane. The point axes 60 should extend parallel to the top plates 16 of the side frames 12 and 14 so that the side frames 12 and 14 may pivot upward and downward from each other about the pivot axes.

The rear cross beam 52 may be of any suitable cross section, although an H-section is generally preferable. The rear cross beam 52 is also provided with a trolley 66 which may traverse the cross beam 52 similar to the trolley 48, and is also provided with a hook 68 connected through a pulley and cable arrangement to a drive source for raising and lowering the hooks 50 and 68 and the work gripping attachments (not shown) which are normally used therewith.

In operation, the operator in the cab 44 can control the entire operation of the gantry crane including the driving and steering of the wheels as well as the traversal of the trolleys 48 and 66 along the respective cross beams 46 and 52 and the raising and lowering of the hooks 50 and 68. Typically, cables such as indicated at 70 and associated pulleys and sheaves are used for controlling the load lifting.

As the operator drives the gantry crane along the ground, when uneven terrain is encountered as for example when one of the wheels would enter into a hole or depression, due to the pivotal connection afforded by the trunnion pins 58, the rear portions of the side frames 12 and 14 may pivot somewhat with respect to the rear cross beam 52. However, the rigid connection of the front cross beam to the front portion of the side frames 12 and 14 results in torsional forces acting upon the front cross beam 46 tending to resist the twisting of the frame. In this manner, when one of the wheels enter a hole, or other depression, it continues to follow the contour of the terrain, i.e. the bottom of the hole, resulting in a flexing of the front cross beam 46. When the wheel returns to level terrain, the forces in the front cross beam 46 return the frame to its normal position. This force distribution arrangement permits a displacement of up to about 10 inches of vertical travel for each of two diagonally opposite wheels, although the amount of travel is somewhat determined by the size of the particular gantry crane in question. Thus, the rear cross beam may be termed a "weak axis", while the front cross beam 46 may be termed a "strong axis". The forces are thereby balanced in the overall apparatus, and ground contact of all four wheels is maintained throughout a substantial variation in the ground.

To provide further flexibility for the use of the gantry crane of this invention, the separable flanges 26 and 28 may have a suitable spacer (not shown) interposed therebetween. In this manner, the height of the crane may be adjusted when higher lifting ranges or higher loads are to be encountered. Thus, an insert 72 as seen in FIG. 5 is provided with top and bottom flanges 74 which may be bolted to flanges 26 and 28 and thereby increase the height of the cross beams 46 and 52 above the ground. Spacers 72 may be provided in any suitable length, and should be of a similar cross section to sections 22 and 24 of the vertical support columns 20. It has been found that when spacers 72 are used, diagonal brace members 30 and 32 provide adequate bracing, and no further bracing is ordinarily necessary.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A gantry crane, comprising:

a pair of spaced parallel rectangular side frames having ground engaging wheel drive means mounted thereon at the lower corners thereof;

a front cross beam rigidly connected to each of said side frames at the upper front corners thereof;

a rear cross beam pivotally connected to each of said side frames at the upper rear corners thereof, whereby as said gantry crane traverses uneven ground, said wheel drive means maintains ground contact and a tortional stress is produced in said front cross beam;

each said side frame including an upper unitary frame portion comprising a horizontal top member having front and rear ends, a first front vertical member extending downwardly from said top member at said front end thereof and having a base, a first rear vertical member parallel to said first front vertical member extending downwardly from said top member at said rear end thereof and having a base, and a first single unitary uninterrupted diagonally disposed bracing beam extending the length of said side frame integrally connected at one end to said first rear vertical member at said base thereof and integrally connected at its other end at the junction of said first front vertical member and said top member;

said top member, said first front and rear vertical members and said first bracing beam of each said side frame being permanently joined in fixed interrelationship;

each said side frame also including a lower unitary frame portion comprising a horizontal bottom member having front and rear ends, a second front vertical member extending upwardly from said bottom member at said front end thereof and having a top, a second rear vertical member parallel to said second front vertical member extending upwardly from said bottom member at said rear end thereof and having a top, and a second single unitary uniterrupted diagonally disposed bracing beam integrally connected at one end to said second rear vertical member at said top thereof and integrally connected at its other end to said bottom member;

said bottom member, said second front and rear vertical members and said second bracing beam of each said side frame being permanently joined in fixed interrelationship;

means for detachably connecting said respective upper and lower unitary frame portions of said side frames at said bases of said first front and rear vertical members and said tops of said second front and rear vertical members, whereby said side frames may be disassembled to facilitate transportion or to permit use of spacing members for varying the height of said gantry crane.

2. The gantry crane of claim 1 and including:

spacing members between the respective bases of said first front and rear vertical members and said tops of said second front and rear vertical members.

3. The gantry crane of claim 1 and including:

load lifting means mounted on at least one of said cross beams.

4. The gantry crane of claim 1 and wherein:

said rear cross beam is pivotally connected to said side frames about pivot axes extending substantially parallel to said top members.

5. The gantry crane of claim 4 and wherein:

each of said top members includes a trunnion secured thereto, said rear cross beam being connected to each said trunnion by a pivot pin.

6. The gantry crane of claim 5 and wherein:

said pivot pins are removable.

* * * * *